US008678897B2

(12) United States Patent
Englert et al.

(10) Patent No.: US 8,678,897 B2
(45) Date of Patent: Mar. 25, 2014

(54) DETECTING AND PROVIDING PLAYER INFORMATION WITH SENSOR AT THE PLAYER SIDE

(75) Inventors: Walter Englert, Burgrieden (DE); Thorsten Habel, Walzbachtel (DE)

(73) Assignee: Cairos Technologies AG (DE)

( * ) Notice: Subject to any disclaimer, the term of this patent is extended or adjusted under 35 U.S.C. 154(b) by 162 days.

(21) Appl. No.: 12/741,363

(22) PCT Filed: Nov. 17, 2009

(86) PCT No.: PCT/EP2009/008162

§ 371 (c)(1),
(2), (4) Date: Jun. 23, 2011

(87) PCT Pub. No.: WO2010/054849

PCT Pub. Date: May 20, 2010

(65) Prior Publication Data

US 2011/0269517 A1 Nov. 3, 2011

(30) Foreign Application Priority Data

Nov. 17, 2008 (DE) ..... 10 2008 057 705

(51) Int. Cl.
*A63F 9/24* (2006.01)

(52) U.S. Cl.
USPC ..... 463/7; 463/8; 463/31; 463/37

(58) Field of Classification Search
USPC ..... 463/7, 8, 31, 37
See application file for complete search history.

(56) References Cited

U.S. PATENT DOCUMENTS 5,513,854 A 5/1996 Daver
5,723,786 A 3/1998 Klapman
(Continued)

FOREIGN PATENT DOCUMENTS

DE 3715976 12/1987
DE 20006816 12/2000
(Continued)

OTHER PUBLICATIONS

Hachisuka, Keisuke, Teruhito Takeda, Usuke Terauchi, Ken Sasaki, Hiroshi Hosaka, and Kyoshi Itao, "Intra-body data transmission for the personal area network." Jul. 14, 2005,Springer-Verlag, Mirosyst Technol 11: 1020-1027.
(Continued)

*Primary Examiner* — Pierre E Elisca
(74) *Attorney, Agent, or Firm* — Workman Nydegger

(57) ABSTRACT

A system for detecting and providing information assigned to soccer players, wherein the system contains a soccer ball (130) comprising a centrally arranged magnetic field generator (142) for generating an alternating magnetic field (150); a transceiver (148) for receiving radio signals (160) and for transmitting collected player information; a control unit (144) for evaluating received radio signals and assigning timestamps to IDs of received radio signals; a source of energy; and a memory for storing and reading out player information based on the IDs with assigned timestamps; and a device (120) for sensing the generated magnetic field in a soccer shoe and for transmitting an ID assigned to the device, comprising a magnetic field sensor (122) for sensing and measuring the magnetic filed (105); a control unit (124); and a transmitting unit (128) for transmitting a radio signal (160) which contains the ID assigned to the device (120), wherein the transmitting unit is actively supplied with energy, and wherein the radio signal is transmitted under control by the control unit.

9 Claims, 4 Drawing Sheets

(56) References Cited

U.S. PATENT DOCUMENTS

| | | | | |
|---|---|---|---|---|
| 6,151,563 | A | 11/2000 | Marinelli et al. | |
| 6,441,745 | B1 | 8/2002 | Gates | |
| 6,921,332 | B2 | 7/2005 | Fukunaga et al. | |
| 7,070,500 | B1 | 7/2006 | Nomi et al. | |
| 7,139,582 | B2 | 11/2006 | Couronne et al. | |
| 8,209,882 | B2 | 7/2012 | Leimer et al. | |
| 8,287,434 | B2 | 10/2012 | Zavadsky et al. | |
| 8,535,185 | B2 | 9/2013 | Englert | |
| 2004/0171388 | A1 | 9/2004 | Couronne et al. | |
| 2005/0003757 | A1 | 1/2005 | Anderson | |
| 2005/0143199 | A1 | 6/2005 | Saroyan | |
| 2005/0171726 | A1 | 8/2005 | Abe et al. | |
| 2006/0047447 | A1 | 3/2006 | Brady et al. | |
| 2006/0178235 | A1 | 8/2006 | Coughlan et al. | |
| 2006/0183462 | A1 | 8/2006 | Kolehmainen | |
| 2006/0252541 | A1 | 11/2006 | Zalewski et al. | |
| 2007/0191083 | A1 | 8/2007 | Kuenzler et al. | |
| 2008/0088303 | A1 | 4/2008 | Englert | |
| 2008/0132334 | A1* | 6/2008 | Nonaka et al. | 463/37 |
| 2008/0207357 | A1 | 8/2008 | Savarese et al. | |
| 2009/0029754 | A1 | 1/2009 | Slocum et al. | |
| 2009/0048044 | A1 | 2/2009 | Oleson et al. | |
| 2009/0048070 | A1 | 2/2009 | Vincent et al. | |
| 2009/0113762 | A1 | 5/2009 | Leimer et al. | |
| 2010/0184564 | A1* | 7/2010 | Molyneux et al. | 482/1 |
| 2010/0280670 | A1* | 11/2010 | Haul | 700/283 |
| 2011/0257935 | A1* | 10/2011 | De Graaf et al. | 702/188 |
| 2011/0287837 | A1* | 11/2011 | Wang et al. | 463/31 |
| 2011/0287878 | A1 | 11/2011 | Englert | |
| 2012/0135825 | A1 | 5/2012 | Claudel et al. | |
| 2012/0262329 | A1* | 10/2012 | Molyneux et al. | 342/42 |
| 2013/0130843 | A1* | 5/2013 | Burroughs et al. | 473/415 |

FOREIGN PATENT DOCUMENTS

| | | | |
|---|---|---|---|
| DE | 10252934 | | 5/2004 |
| DE | 10338620 | | 3/2005 |
| DE | 10 2007 001820 | B3 | 1/2008 |
| DE | 102007017549 | A1 | 4/2008 |
| FR | 2726370 | | 5/1996 |
| FR | 2753633 | | 3/1998 |
| GB | 2190525 | | 12/1987 |
| WO | WO 97/20449 | | 6/1997 |
| WO | WO 9837932 | | 9/1998 |
| WO | WO 99/34230 | | 7/1999 |
| WO | WO 99/36859 | | 7/1999 |
| WO | WO 99/53339 | | 10/1999 |
| WO | WO 01/66201 | | 9/2001 |
| WO | WO2007/014700 | | 2/2007 |

OTHER PUBLICATIONS

"What is personal area network?—Definition from Whatis.com", Apr. 22, 2001, Whatis.com, available at <http://searchmobilecomputing.techtarget.com/definition/personal-area-network>.

Tsaousidis N.; Zatsiorsky V. "Two types of ball-effector interaction and their relative contribution to soccer kicking", Dec. 1996, Elsevier, Human Movement Science, vol. 15, No. 6, pp. 861-876.

U.S. Appl. No. 11/672,879, Aug. 6, 2009, Office Action.

U.S. Appl. No. 11/672,879, May 7, 2010, Office Action.

U.S. Appl. No. 13/129,784, Sep. 13, 2012, Office Action.

U.S. Appl. No. 13/129,784, Jun. 12, 2013, Notice of Allowance.

Hall, et al., "Antennas and Propagation for Body-Centric Wireless Communications", Aug. 2006, Chapter 1.

U.S. Appl. No. 11/672,879, Dec. 11, 2013, Office Action.

* cited by examiner

DETECTING AND PROVIDING PLAYER INFORMATION WITH SENSOR AT THE PLAYER SIDE

The present invention refers in general to the detection and provision of player-related information in ball games and specifically to the detection and provision of player-related information in those ball games, e.g. soccer matches, where a game ball is hit by a playing device that can be assigned to a player.

There is an increasing interest in studying objects in motion in ball games, particularly the persons participating in the ball game and the game object, i.e., the game ball, in their motion sequence, their interaction and with respect to further typical characteristics so as to allow an objective evaluation within the scope of these complex systems.

Especially in amateur, club or professional soccer matches, there is an increasing interest in making the complex match sequences and optically insufficiently resolvable game ball treatments analytically processable. Questions, such as who touched the object of the game how many times, who had a considerable influence on the object of the game for how long and who passed the object of the game on to which opponents or teammates, as well as questions regarding the way of treatment of the object of the game are indicative in their answers of the outcome of a match and furnish information on the skills of a player of the ball game.

Answers to these questions are of particular interest within the scope of training units and their analysis. By contrast, it is generally undesired to have a negative influence on the professional match operation through possibly disruptive technical measures.

Playing devices and game objects (game balls) can be accelerated in golf, tennis or soccer to speeds that are so high that the detection of the object during the movement requires specifically adapted technology. Technical means that have so far been employed, predominantly cameras, often fail to meet the requirements made on precision or require excessive processing work. Moreover, known methods for determining positions by means of corresponding transmitter and receiver combinations do not show the necessary spatial resolution and often suffer from problems caused by excessively dimensioned transmitter/receiver components that do not permit a reasonable use in the sports devices, such as game ball, soccer shoe, tennis racquet or golf club.

Hence, there is particularly the need for a solution that makes it possible to determine in ball games, particularly soccer, how often a player hit the ball, for how long said person was in the possession of the ball, i.e. in a position determining the ball movement, with which shooting force said person kicked the ball and when, and which running track or distance the respective player covered in the playing field with or without possession of the ball.

In already known solutions the shooting force was sensed via pressure sensing in the ball, preferably soccer ball. Running tracks were typically evaluated with known pedometers or evaluated by optical sensing of the player preferably via video and corresponding manual or automatic evaluation.

To be more specific, the applicant of the present application already made the proposal in former times, cf. DE 10 2007 001 820, that a coil should be inserted into the shoe, particularly soccer shoe, the coil then generating the desired magnetic field. This former solution for detecting the player who hit the ball was based on the finding that a magnetic field which can be assigned to the player is generated in the soccer shoe by way of a magnetic field generator, that the magnetic field which can be assigned to the player is sensed with a magnetic field sensor in the ball to obtain, on the basis of such information, ball contact information that indicates whether the player had contact with the ball.

Although this solution has turned out to be quite useful in practice, the problem exists that especially with very lightweight soccer shoes the space needed, and thus the weight costs for the technique required for generating a sufficiently strong magnetic field, does not exist to an adequate degree in the soccer shoe and that the installation of such a device also negatively affects the comfort of the soccer shoe due to its space requirements.

The present invention finds a remedy for this. The present invention is based on the finding that it is possible and advantageous to generate the magnetic field no longer in the soccer shoe or generally at the player side, but instead of this to install for once field-generating coils in the ball. The soccer shoe itself just comprises a magnetic field sensor for this application, said sensor sensing the magnetic field of the ball upon contact with the ball or entry into the close surroundings of the ball and transmitting an identification code (ID), which is assigned to the player, to the ball. This means that the ball contact triggers the output of an ID which is then sent to the ball and temporarily stored there. Alternatively, it is also possible that the shoe sends this ID to a center. For technical reasons and particularly in consideration of possible ranges and transmitting powers, it is however advantageous when the ID is sent to the ball, temporarily stored there and e.g. after a match or a training unit read out once with all of the collected player information.

It should particularly be mentioned that although the ball contact is detected via a magnetic field with the help of the magnetic field sensor located in the shoe, the associated ID and preferably measured magnetic field strengths are then transmitted with a radio module e.g. in the 2.4 GHz range. The invention is not limited to 2.4 GHz as the carrier frequency of the radio signals. Instead of this, other suitable high-frequency radio carriers may also be used. The magnetic field produced in the ball shows a much lower frequency and is e.g. in the range of 3 kHz, which has turned out to be advantageous. The possible suitable frequency range may be between 1 to 100 kHz.

A suitable radio module for the shoe is produced by the company Nordic and already used for WLAN applications.

Preferably, the shoe, just like the ball, has its own source of energy which, however, may be tiny. Although a solution is possible in which the shoe gets the energy it needs from the magnetic field of the ball, the preferred design comprises active components in need of a battery support.

The present invention makes it possible to detect the skill of a player by evaluating selected characterizing parameters. What is particularly detected is how often a specific player has a ball contact for how long and whether the player accomplishes a successful pass and how often. The determination of an objectified measure of the skill of a player can thereby be achieved by evaluating the collected data. Moreover, a successful pass can be detected by recognizing that the kicked ball is fetched by a teammate of one's own team. This is possible by way of comparing the transmitted IDs with respect to their assignment to players of the same team.

Since it may happen that several players are near the ball at the same time and thus within the sphere of influence of the magnetic field generated in the ball, it is provided according to a special aspect of the present invention that upon detection of the magnetic field by the magnetic field sensor, the magnetic field strength is also detected as an absolute magnitude and then transmitted via the radio module together with the ID of the shoe to the ball. On the basis of these received signals, a control unit in the ball can determine the ID that was received together with the highest field strength value. The determined ID identifies the shoe, or player, the associated magnetic field sensor of which came closest to the ball. The associated player can then be identified as the player striking the ball, or significantly striking the same, to whom the ball contact is ascribed.

The frequency in question of preferably three kHz for the alternating magnetic field of the ball offers the advantage that said frequency is not widely used, and that is why in practice it has turned out to be a very useful frequency. Since above all training facilities and locations suited as leisure play fields are qualified as locations of use for the present invention, apart from the designated play fields, an interference with widely used carrier frequencies is not desired. Furthermore, the magnetic field sensor preferably contains a magneto-resistive element.

Moreover, the present invention allows the measurement of the ball speed after contact with the soccer shoe. This permits the determination of the ball power or energy and of the shooting force applied by the player. Especially the installation of magnetic field sensor and radio transmitter in the shoe can be used for determining the shooting force. This is done in that a measurement is carried out at which speed the ball has distanced itself from the shoe after ball contact. To this end preferably several field strength values must be determined and transmitted with the associated timestamps from the shoe to the ball.

Alternatively, the ball speed after ball contact can also be determined through an inventive calibration by means of a control device already in the shoe. The calibration is carried out in that upon ball contact the typical distance between the ball center, in which the magnetic field-generating coils are positioned, and the place of the sensor in the shoe is determined. Preferably, the sensor is placed in the shoe such that, independently of the kind of shooting technique used, approximately the same distance between sensor and ball center prevails upon impact of the ball on the shoe. The present invention is here based on the finding that the distance upon ball contact represents the minimum distance between magnetic field generator and magnetic field sensor and that the field strength is maximal because of this maximal approach of magnetic field coils and magnetic field sensor. If a measurement is then taken as to the point in time at which the field strength has e.g. been halved in relation to this maximum value, this corresponds to a corresponding change in the distance. Hence, the speed can be determined from the determination of the time difference between the determination of the maximum value and e.g. the 50% value of the field strength.

Preferably, to avoid any dependence on (ball) rotation-caused field strength variations, several coils are used with corresponding electrical driving in the ball in such a way that the resulting magnetic field vector rotates at a high frequency, and during the sensing operation by the magnetic field sensor in the shoe the maximum value thereby occurs at least approximately. This permits an approximate exclusion of the negative influence of the rotation of the ball.

Preferably, in order to make sure that the magnetic field sensor really determines the highest magnetic field strength value at the above-mentioned distance-calibration value of the greatest approach between ball center and shoe surface, an instruction signal may be sent from the ball to the shoe, which signal is received via a radio receiver in the shoe and prompts the measurement of the magnetic field strength as the maximum field strength. Preferably, the instruction signal is sent due to the determination of a ball contact by means of a pressure sensor arrangement in the ball. Due to the instruction received, the control unit of the shoe is also instructed to send the detection signal with ID of the shoe to the ball at the time of the measurement of e.g. the 50% value of the field strength. Since the ball stores the timestamp of the transmission of the instruction signal, it can then determine the speed of the ball after ball contact from the received detection signal and from this timestamp with knowledge of the distance calibration value, and thus the kinematic ball energy and the shooting force.

Furthermore, the present invention makes it possible to determine the running tracks of individual players during a training unit or during a match. Video evaluations, as are widely carried out for professional matches, require sophisticated video monitoring that does not exist in typical training operations or on leisure play areas. That is why a simple solution is desired.

The present invention suggests that also a tilting of the foot relative to the Earth's magnetic field can be sensed through the magnetic field sensor in the shoe. By contrast, a foot that is in full ground contact at the moment is tilted relative to the Earth's magnetic field in a constant way for some time and will therefore produce a continuously recurring reference signal for the magnetic field measurement. The moved foot differs from this reference signal through its motion sequence. The determination of the ground contact phases makes it possible to draw conclusions as to the step number and thus also the step frequency of the respective player. With the introduction of appropriate approximations for the step length, this permits, particularly for non-ball games, a sufficiently exact determination of the running tracks covered, whereas a determination of the covered running track in this way for a ball game alone is only approximately reliable.

Preferred embodiments of the present invention shall now be explained in more detail with reference to the enclosed drawings, in which.

To illustrate the invention, the attached drawings are now explained in more detail. The following description of the drawings starts from embodiments of the invention, but the present invention is not restricted to the individual embodiments. The present invention is particularly explained in detail for a soccer match, but is not limited in its application to this special ball game.

Figure 1:
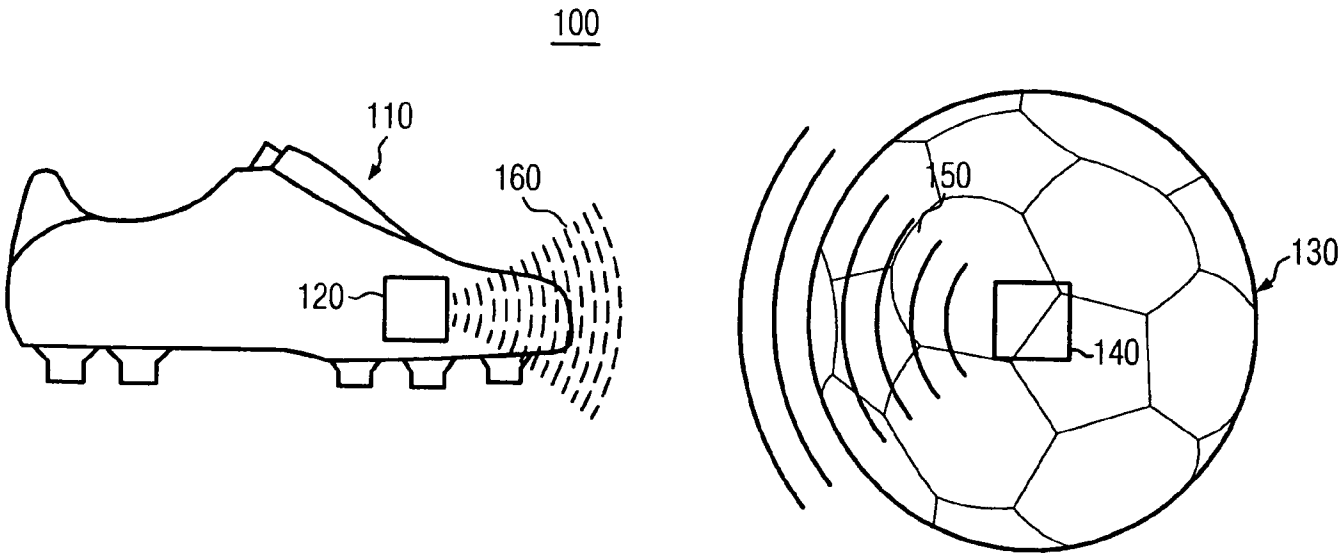
FIG. 1 is a schematic illustration of a system according to an embodiment of the present invention.

FIG. 1 is a schematic illustration showing a system consisting of a device installed in a soccer shoe and of a game ball according to an embodiment of the present invention. The system 100 comprises a soccer shoe 110 and a game ball 130. The present invention is not limited to applications in soccer matches. Rather, other ball games with a playing device intended for impact on the game ball are possible as applications for the present invention. Likewise, ball games in which the game ball is hit with bare hands without interposition of a playing device can represent applications for the present invention by way of mounting a magnetic field sensor device 120 by means of a wristband, or the like, for instance on the players' wrists.

The soccer shoe 110 contains a magnetic field sensor device 120. The game ball 130 contains a system 140 with a magnetic-field generating device which is preferably mounted in the center of the game ball. This can be accomplished by way of clamping between suitable springs, flexible foam or suitably shaped arrangements of interior-space bubbles. The present invention, however, is not limited to these mounting methods. The magnetic field-generating device serves to generate a magnetic field with a preferably predetermined range of detection. The selected range of detection allows the determination of contacts between soccer shoe and game ball and also a determination of soccer shoes positioned near the game ball so that conclusions can be drawn as to the so-called ball possession of individual players. Ball possession must here be understood as a period of time during which a specific player has an essential influence on the movement of the ball in his/her direct vicinity. This must be distinguished from the ball trajectory after the game ball has been kicked by a player with a sufficient shooting force because, although the player has a considerable influence on the movement of the game ball initially for the whole time of flight, the game ball is not within the player's sphere of influence. Suitable values for the detection range may be 50 cm, or even smaller values, such as 20 cm.

The magnetic field 150 generated in the game ball 130 by system 140 with magnetic field-generating device preferably exhibits a frequency of 3 kHz and is decreasing to the outside with the radius starting from the place of generation, preferably from the center of the ball.

The shoe 110 contains a magnetic field sensor device 120 so as to be able to detect the magnetic field 150 of the game ball 130. After a magnetic field has been detected, the magnetic field sensor device 120 can transmit a detection signal with an ID and preferably the magnetic field strength measured at the location of the shoe back to the game ball 130. To this end a high-frequency radio signal of e.g. 2.4 GHz is used as the carrier frequency.

Figure 2:
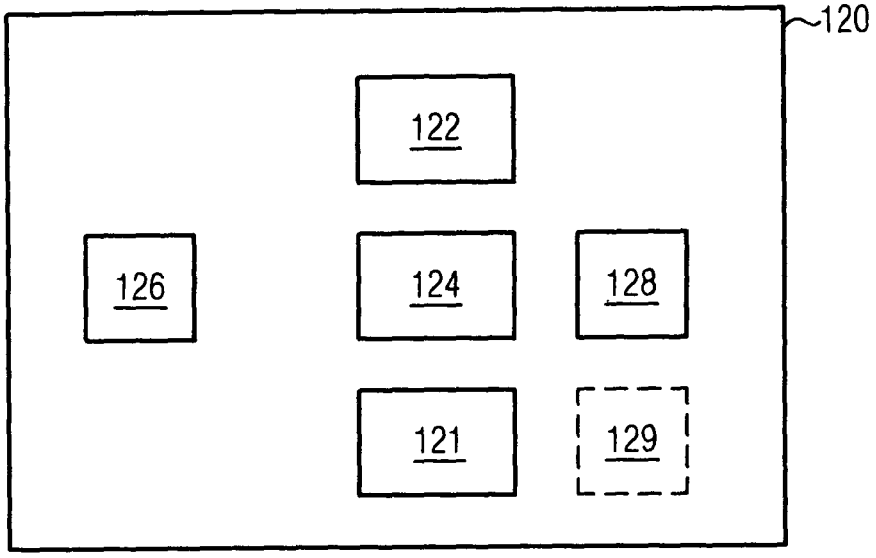
FIG. 2 is a schematic illustration of a device at the player side according to an embodiment of the present invention.

FIG. 2 shows a schematic block diagram of the magnetic field sensor device 120. Said device contains magnetic field sensor 122. Magnetic field sensor 122 preferably contains a magneto-resistive element or a Hall element. If the magnetic field strength is measured with magneto-resistive sensors as the magnetic field-dependent resistors, these may be connected to form a bridge. The output signal of the bridge can be amplified with a differential amplifier. The output voltage is a direct measure of the field strength of the measured magnetic field. To be able to obtain an evaluatable signal with each possible rotation axis of the game ball, two or three sensors, each offset by 90°, may be used.

Alternatively, the field strength can be measured with Hall sensors. Hall sensors produce a voltage in proportion to the field strength. Said voltage can be amplified with the help of a differential amplifier. The output voltage is a direct measure of the field strength of the magnetic field. This voltage can be evaluated either discretely via an analog circuit or with the help of a control unit, e.g. a microcontroller. To obtain an evaluatable signal with every possible rotation axis of the game ball, two or more sensors, which are offset by 90°, may be used.

Device 120 further contains a control unit 124 which can be provided as a microcontroller or an application-specific integrated circuit. Control unit 124 controls instructions and the evaluation, further processing and storage of magnetic field measurement values and generates associated timestamp values that can be passed on to a memory 121 and/or to a transmitting unit 128. Device 120 further contains a source of energy 126. The source of energy 126 is a battery according to an embodiment of the present invention. Device 120 is e.g. fed via a lithium battery. The capacity of the battery is here designed such that the functionality of the electronic system in the device 120 is guaranteed for a specific number of several hundred or thousand operating hours. Preferably, the source of energy 126 can be provided as an exchangeable unit that can be replaced by the user without any major efforts. Optionally, device 120 further includes an acceleration sensor 129.

Figure 3:
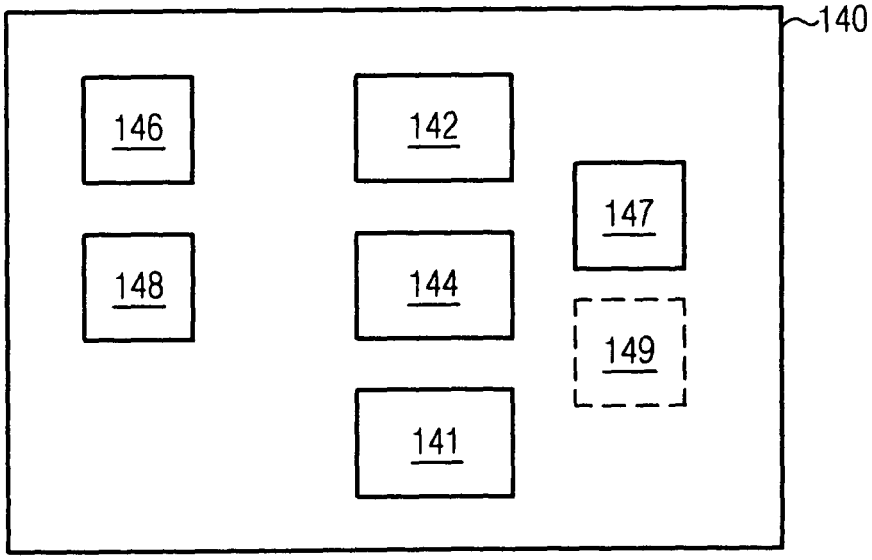
FIG. 3 is a schematic illustration of a system at the ball side according to an embodiment of the present invention.

In a block diagram, FIG. 3 schematically shows a system 140 in game ball 130 according to an embodiment of the invention. System 140 is shown as a self-contained system. This illustration serves the simplified highlighting of the means provided for the present invention in the game ball. The invention also comprises an arrangement of the various units, including sensors, transceiver and source of energy, distributed in the game ball. System 140 comprises magnetic field-generating unit 142. Magnetic field-generating unit 142 comprises at least one magnetic coil which is sufficiently dimensioned for generating a magnetic field of the specific detection range. Unit 142 is preferably fed with energy from source of energy 146, which is a battery according to one embodiment of the present invention. For instance, a lithium battery is provided as the source of energy 146. The capacity of the battery may here be configured such that the functionality of the electronics in system 140 is guaranteed for a specific number of operating hours, e.g. several hundred to several thousand hours. A rechargeable source of energy 146 may also be provided. For instance, a source of energy 146 can be used that in a readout process of the data stored in memory 141 is recharged through induction or direct energy supply. Furthermore, control unit 144 is provided in the game ball. Control unit 144 specifically serves to control the transceiver 148, to evaluate data and to control the communication flow in system 140. Especially detection signals received by transceiver 148, which are transmitted by a device 120 to the game ball 130, are detected by control unit 144, further processed and optionally stored with addition of associated timestamps in memory unit 141.

The information data sets stored in memory unit 141 can be read out by a central readout station from system 140. To this end transceiver 148 may be provided for data transmission. Alternatively, a second communication unit, which is not shown in FIG. 3, is provided.

Furthermore, according to preferred embodiments, device 140 can contain a pressure sensor 147 and an acceleration sensor 149. Said additional sensors can be mounted outside the ball center in the game ball and connected for readout via control unit 144.

Energy sources 126 and 146 in FIG. 2 and FIG. 3 serve to supply energy to the complete electronic device 120 and the complete electronic system 140, respectively.

According to a further preferred embodiment of the invention the use of several coils, preferably three coils, in magnetic field-generating unit 142 is intended. If only a single coil is provided in the game ball, problems might arise that are caused by the rotation of the game ball. A single coil produces a dipole field which then leads to rotation-caused field strength deviations in the magnetic field measurement on the shoe. In other words, the field strength measured on the shoe depends on the angle at which the generating coil is positioned relative to the shoe and the magnetic field sensor at the time of the ball contact. To be able to substantially exclude this geometric influence, it is intended according to this preferred embodiment of the present invention that a rotating field vector is produced by using preferably three coils with corresponding electrical driving (vector noise). The rotating magnetic field should have a rotational speed that is very high in comparison with the possible rotational speed of the game ball. This is achieved in that at least a maximum value is determined by the magnetic field sensor approximately at each time of a ball contact through the very rapid changing, which maximum value then represents the optimum orientation between game ball and sensor. This means that in comparison with the possible game ball rotation the rotary frequency of the field vector is so high that the game ball rotation no longer rules out an exact determination of the field strength. This excludes a negative influence of the game ball rotation in the magnetic field strength determination.

Figure 4:
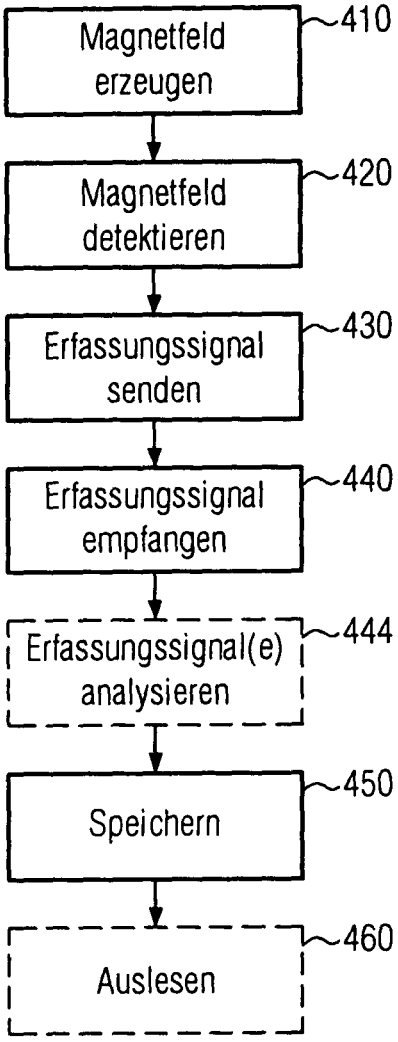
FIG. 4 shows a flow diagram for explaining a method for detecting ball contact information according to an embodiment of the present invention.

FIG. 4 shows a flow diagram for explaining a method for detecting a ball contact or almost a ball contact between soccer shoe 110 and game ball 130.

System 140 in game ball 130 first generates a magnetic field for the desired duration of the data determination, step 410. If a device 129 with magnetic field sensor 122 is now getting into the detection range of the generated magnetic field, the magnetic field sensor senses the magnetic field, step 420, and a detection signal is transmitted by the device 120 via the transmitting unit 128 to the game ball, step 430. This detection signal contains an identification code (ID) that is unambiguously assigned to the pair of soccer shoes for player determination. The code transmission can take place by modulating a carrier signal, which is preferably transmitted at 2.4 GHz. To this end a radio module of the company Nordic, which is known from WLAN applications, is e.g. used as the transmitting unit 128.

Preferably, the absolute value of the magnetic field strength, which is determined by magnetic field sensor 122, is passed on to control unit 124 for further processing, for storage in memory unit 121, and for transmission to the game ball via transmitting unit 128. In this case the measured magnetic field strength is transmitted together with the ID as a detection signal to the game ball. This permits an identification of a player really kicking the game ball in situations where several soccer shoes of different players move into the sphere of the generated magnetic field with correspondingly different ID codes and transmit, in conformity with steps 420 and 430, corresponding detection signals to the game ball that in this respect forward competing information to the game ball. In step 440, the device 140 in the game ball receives the detection signal(s). A timestamp is then assigned to the received detection signal and the pair of values of ID and timestamp is stored in memory unit 141 of the game ball to be read out later.

If competing ID codes of different detection signals are received for a specific tolerance period, the detection signal with the highest reported and measured field strength can be determined according to the preferred embodiment in which, apart from the ID code, the measured field strength value is transmitted. According to this preferred embodiment, in such competing situations the ID code that was transmitted with the highest magnetic field strength measurement value is stored in the memory with timestamp. In step 450, the consolidated ID codes are stored with timestamps in memory unit 141.

According to preferred embodiments all of the value pairs stored in memory 141, which in addition can be pre-processed by control unit 144, are read out once only after a specific training or playing unit.

Figure 5:
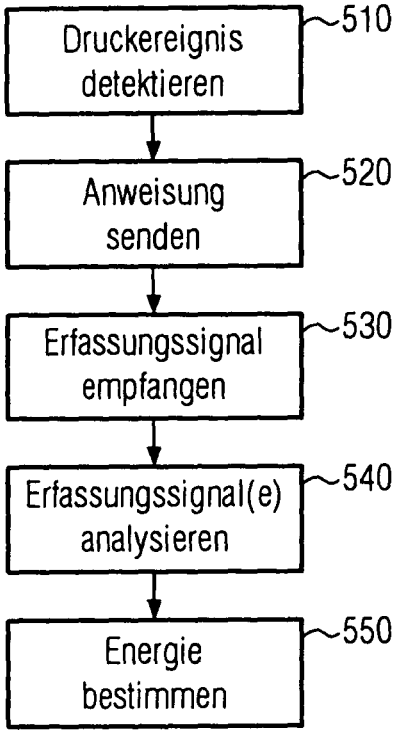
FIG. 5 shows a method for determining the speed of a game ball after ball contact according to an embodiment of the present invention.

FIG. 5 shows a flow diagram for explaining a method for determining the shooting force upon ball contact according to an embodiment of the present invention. In this embodiment, system 140 in the game ball 130 contains a pressure sensor 147. At the ball side the pressure sensor is used for determining the point in time at which the game ball is hit by a soccer shoe or at which it hits against an obstacle. After detection of such a pressure event on the game ball, step 510, the game ball sends an instruction to potential magnetic field sensor devices 120 of soccer shoes positioned in the magnetic field to immediately carry out a measurement of the magnetic field at the location thereof, step 520. In this embodiment the transmitting unit 128 is also a radio receiving unit. The instruction received via transmitting/receiving unit 128 is also understood by the device 120 as an instruction to periodically measure, apart from the execution of the immediate magnetic field strength measurement for determining a maximum field strength, also the magnetic field strength for a period of time until e.g. a 50% value of said maximum field strength is measured. Device 120 transmits the point of time of the measurement of the e.g. 50% value of the maximum field strength to the game ball, again via transmitting unit 128 and transreceiver unit 148 of the game ball as the receiver unit. In the game ball, the timestamp of the transmission of the instruction is stored in memory 14. Thus, the comparison of the received timestamp with the stored timestamp permits the determination of a time difference $\Delta t$.

On the basis of the finding of a distance calibration value, the speed of the game ball after ball contact can now be determined and thus approximately the shooting force. The ball speed corresponds approximately to the ratio of the distance covered between the time of impact and the time of measurement of the 50% value to the time difference. The distance between sensor device 120 and the game ball center in which system 140 is installed is here used as the calibration value for the minimal distance upon ball contact. It is here advantageous to place the magnetic field sensor 122 in the soccer shoe such that, independently of the selected shooting technique with correspondingly varying impact area of the game ball on the soccer shoe, an approximately identical distance between device 120 and game ball exists upon impact. This calibration distance may be stored either in memory 121 of the device on the shoe or in memory 141 of the system 140 in the game ball. If the measured field strength decreases e.g. to 50% of the maximum value, the distance has increased accordingly in relation to the calibration value. Hence, the ratio of this increase in distance to the difference of the timestamp corresponds approximately to the ball speed at the place of the second timestamp.

Alternatively, device 120 can send a sequence of data sets of the ID and of the respectively measured magnetic field strength with corresponding timestamps to the game ball. This allows the time resolution of the locus of the game ball relative to the magnetic field sensor 122 and thus with additional use of a calibration distance, as can preferably be determined as above, a very exact determination of the shooting force applied, which in the final analysis represents the desired information regarding the analyzed player. As an alternative, the energy and thus approximately the shooting force applied can be approximately determined from the above-determined game ball speed.

Moreover, a further independent determination of the shooting force can be made by means of the pressure sensor 147 and/or an acceleration sensor 149 in the game ball. A pressure sensor arrangement can detect the degree of deformation of the game ball. The greater the deformation, the greater is the shooting force. To this end the peak value and the pressure curve of the internal pressure are measured with the help of the pressure sensor. Control unit 144 can determine the energy supplied to the ball with the help of a comparison with a group of curves. Such a group of curves can be determined empirically by means of a suitable test system. Further steps for calculating the shooting force on the basis of the energy values determined by means of various sensors can e.g. be taken outside the game ball.

Figure 6A:
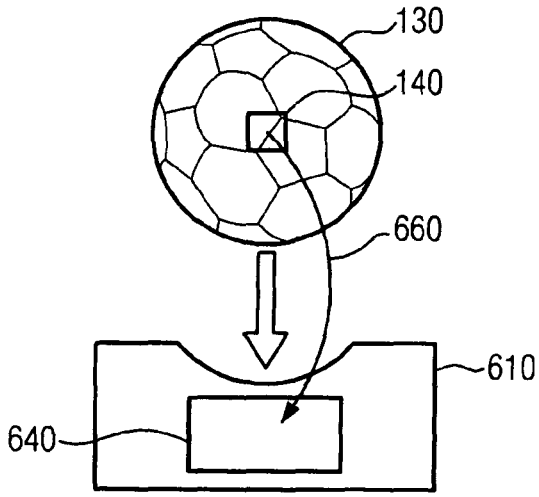
FIG. 6A is a schematic illustration of a readout arrangement according to an embodiment of the present invention.
Figure 6B:
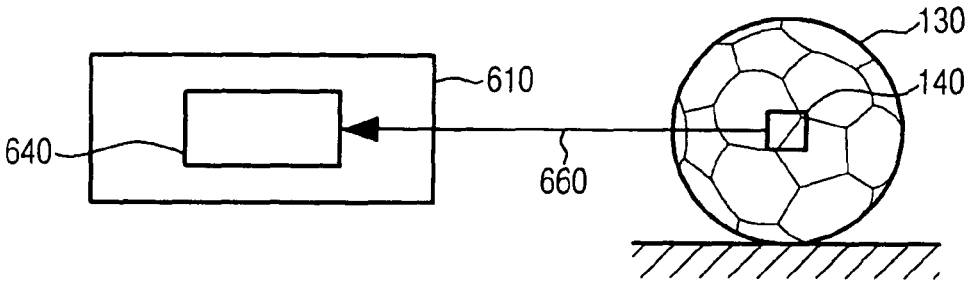
FIG. 6B is a schematic illustration of an alternative readout arrangement according to an embodiment of the present invention.

FIGS. 6A and 6B are schematic illustrations showing preferred readout arrangements according to embodiments of the present invention.

According to the embodiment shown in FIG. 6*a*, game ball 130 is moved close to or onto a concave trough of a readout device 610 with radio transceiver 640 for reading out. In this process the radio transmission 660 is provided between transceiver 148 and transceiver 640 within the short range.

According to the embodiment, shown in FIG. 6B, the player information stored in memory 141 of the game ball, or alternatively the collected data, can be transmitted directly by the control unit 144 in bypassing memory 141 via transceiver 148, e.g. from the playing field, to a readout device 610 with radio receiver 640. Portable media players or a cellular phone are provided as readout device 610 according to embodiments.

According to the present invention, it is possible through readout of a game ball of the invention, to gain detailed information on characteristics of the players participating in the game. Apart from a direct analysis of the performance development of a player, this permits, for instance, the uploading of player-related characteristics in centrally managed databases that permit a comparison of amateur players e.g. via the Internet. For instance, it is of interest to various providers that players voluntarily post their data on the Internet for a mutual sports comparison. Furthermore, the present invention makes it possible that players become comparable in absolute terms in the sense of objectified performance values even if these have never played with or against one another, as is possible in golf sports in a similar way. In the semiprofessional or professional sector, it is further intended to make the training performance of players comprehensible and to draw up training schedules on the basis of the data determined.

The invention claimed is:

1. A game ball for detecting and providing information assigned to players of a ball game, wherein the game ball contains:

a magnetic field generator for generating an alternating magnetic field, wherein the magnetic field generator contains at least three coils that are electrically actuated such that a resulting magnetic field vector rotates in three dimensions, wherein the frequency at which the resulting magnetic field vector rotates is considerably higher than a rotation frequency of the game ball that is possible during the game;

a transceiver for receiving radio signals which are transmitted in response to a detection of the generated alternating magnetic field and which contain an ID which can be assigned to a player, and for transmitting collected player information;

a control unit for evaluating received radio signals and for assigning timestamps to IDs of received radio signals;

a source of energy; and a memory for writing and reading out player information based on the IDs with assigned timestamps.

2. The game ball according to claim 1, which further contains a pressure sensor arrangement and an acceleration sensor.

3. A system for detecting and providing information assigned to soccer players, wherein the system contains:

a soccer ball comprising a centrally arranged magnetic field generator for generating an alternating magnetic field;

a transceiver for receiving radio signals and for transmitting collected player information;

a control unit for evaluating received radio signals and assigning timestamps to IDs of received radio signals;

a source of energy; and a memory for storing and reading out player information based on the IDs with associated timestamps; and a device for sensing the generated magnetic field in a soccer shoe and for transmitting an ID assigned to the device, comprising a magnetic field sensor for sensing and measuring the magnetic field;

a control unit; and a transmitting unit for transmitting a radio signal which contains the ID assigned to the device, wherein the transmitting unit is actively supplied with energy, and wherein the radio signal is transmitted under control of the control unit.

4. The system according to claim 3, wherein the generated alternating magnetic field has a frequency of 3 kHz and the radio signal has a carrier frequency of 2.4 GHz.

5. The system according to claim 3 or 4, which further contains:

a readout device with radio receiver for receiving the collected player information.

6. A method for detecting and providing player information using a sensor at the player side, the method comprising the steps of:

generating, with at least three coils that are electrically actuated, a magnetic field in a game ball, wherein a resulting magnetic field vector rotates in three dimensions, and wherein the frequency at which the resulting magnetic field vector rotates is considerably higher than a rotation frequency of the game ball that is possible during the game;

detecting the magnetic field with a magnetic field sensor of a device mounted in a playing device of a ball game, wherein the playing device can be assigned to a player;

transmitting a radio signal by the device, wherein the radio signal contains an ID assigned to the device; and receiving the radio signal including the ID in the game ball.

7. The method according to claim 6, further comprising the steps of:

assigning a timestamp to the ID; and storing the ID with timestamp.

8. The method according to claim 7, further comprising the steps of:

measuring the magnetic field strength with the magnetic field sensor, wherein transmitting a radio signal further comprises transmitting a radio signal by the device, wherein the radio signal contains an ID assigned to the device and the measured magnetic field strength;

analyzing the radio signal, comprising comparing the measured magnetic field strength with measured magnetic field strengths contained in other radio signals which are received in a specific time frame around the reception of the radio signal, and determining a maximum magnetic field strength for the time frame; and storing that ID with assigned timestamp that is assigned to the maximum magnetic field strength.

9. The method according to any one of claims 6 to 8, further comprising the steps of:

determining a contact event by means of a pressure sensor included in the game ball;

transmitting a measurement command by the game ball;

measuring a reference magnetic field strength by the magnetic field sensor in response to the reception of the measurement command;

determining a point in time at which the magnetic field strength measured by the magnetic field sensor has dropped to a specific fraction of the reference magnetic field strength; and transmitting a radio signal to the game ball, including the ID and a timestamp corresponding to the determined point in time to the game ball.

* * * * *